United States Patent [19]

Watson et al.

[11] 4,022,538

[45] May 10, 1977

[54] EXPANSION JOINT SEAL

[75] Inventors: Stewart C. Watson; Thomas C. Bowman, both of Buffalo, N.Y.

[73] Assignee: Watson-Bowman Associates, Inc., Buffalo, N.Y.

[22] Filed: Apr. 25, 1973

[21] Appl. No.: 354,360

Related U.S. Application Data

[63] Continuation-in-part of Ser. No. 264,585, June 20, 1972, abandoned.

[52] U.S. Cl. ..... 404/69; 404/67

[51] Int. Cl.[2] ..... E01C 11/12

[58] Field of Search ..... 404/47, 48, 56, 64, 404/68, 69, 66, 67; 14/16; 52/395

[56] References Cited

UNITED STATES PATENTS

| | | | |
|---|---|---|---|
| 2,580,034 | 12/1951 | Lyons | 404/48 X |
| 3,331,294 | 7/1967 | Waller | 404/66 |
| 3,367,077 | 2/1968 | Johnston | 52/395 X |
| 3,375,763 | 4/1968 | Welch | 404/67 X |
| 3,390,501 | 7/1968 | Driggers | 52/395 |
| 3,394,639 | 7/1968 | Viehmann | 404/47 |
| 3,435,574 | 4/1969 | Hallock | 404/69 X |
| 3,606,826 | 9/1971 | Bowman | 404/69 X |
| 3,650,184 | 3/1972 | Kolm et al. | 404/50 |
| 3,690,226 | 9/1972 | Hein | 404/68 |
| 3,696,575 | 10/1972 | Armstrong | 52/395 X |
| 3,713,368 | 1/1973 | McDowell et al. | 404/67 |
| 3,750,359 | 8/1973 | Balzar et al. | 52/396 X |
| 3,758,220 | 9/1973 | Hein | 404/67 |
| 3,779,660 | 12/1973 | McGeary et al. | 404/69 |

FOREIGN PATENTS OR APPLICATIONS

| | | | |
|---|---|---|---|
| 2,007,833 | 1/1970 | France | 14/16 |
| 1,011,138 | 6/1957 | Germany | 52/395 |

*Primary Examiner*—Roy D. Frazier
*Assistant Examiner*—Rodney H. Bonck
*Attorney, Agent, or Firm*—Cushman, Darby & Cushman

[57] ABSTRACT

A seal and cover for expansion joints in roadways and bridges comprised of a block of elastomer having grooves extending downwardly from its top surface to allow for expansion and contraction. A metal plate is secured to the top of the elastomer block to protect the block and help carry the weight of vehicles over the joint. The plate may also have grooves in its top surface to reduce the likelihood of vehicles skidding as they cross the joint.

8 Claims, 5 Drawing Figures

EXPANSION JOINT SEAL

This is a continuation-in-part of prior U.S. application of Stewart C. Watson and Thomas C. Bowman, Ser. No. 264,585, filed June 20, 1972, and now abandoned.

The present invention relates to an expansion joint cover and seal comprised of an elastomeric material and clad with one or more reinforcing metal plates. The invention is particularly applicable to joints in surfacing materials. Such surfacing materials are principally various kinds of concrete, by which we mean a mass of aggregate such as gravel or crushed rock held together by a binding material, generally Portland cement or asphalt or a similar bituminous material. However, the invention also is applicable to joints in other paving materials such as bricks and blocks of various types.

Surfacing materials on bridges, roadways and airport runways are provided with spaced joints between adjoining slabs, which will be referred to herein generally as pavement or paving slabs, to allow for thermal expansion during warm weather. Moisture and foreign substances can enter those joints when they are open and damage structures below or behind the pavement, and also prevent the joint from closing subsequently when the pavement expands. The joint also creates discontinuities which vehicle tires enter, and which, e.g. can damage tires. Consequently, various devices have been constructed to cover and/or seal expansion joints.

Among devices used to cover joints are a variety of metal plates including interdigitating fingers, known as finger joints, and plates fastened to one of the adjoining pavement sections and in sliding contact with the other adjoining section, known as sliding plate joints.

Seals generally consist of an elastomeric material constructed in a shape which is capable of expansion and contraction. They include many varieties of hollow tube, with or without internal reinforcing ribs, and elastomeric devices having slits which can open or close.

The present invention is concerned with a device which can both cover such expansion joints and seal them against intrusion of foreign substances. In particular, it relates to a preformed or prefabricated seal, as distinguished from a field molded seal. The seal is mounted over the joint, and its upper surface is substantially in line with the surface of the roadway or bridge, forming in effect a portion of the surface. Large portions of the surface are covered with a plate having a skid resistant surface which protects an expandable elastomeric body under the plate.

In its preferred form, the seal is essentially a solid rubber block having one or more grooves extending inwardly from its top and/or bottom surfaces and clad on its top surface with one or more corrosion resistant metal plates. The plates cover the edges of the rubber at the grooves and large portions of the top surface of the seal, preferably including the portion over the joint, and provide a skid and wear resistant surface on the rubber.

This invention will be better understood from the following detailed description of preferred embodiments, reference being made to the drawings in which.

Figure 1:
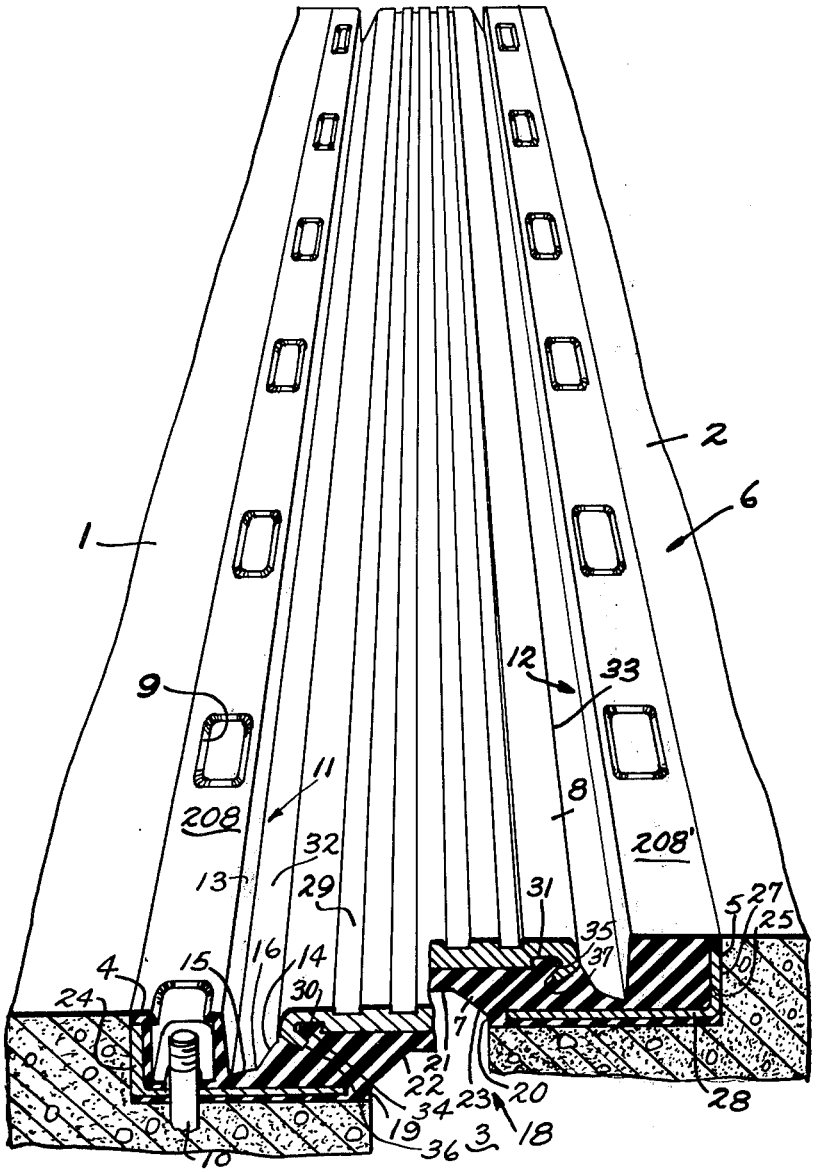
FIG. 1 is a perspective view of a seal according to the invention in a relatively small joint showing cross-sections of two different portions of the seal.

Referring to FIG. 1, there are shown two adjoining concrete slabs 1 and 2, separated by a space 3, this space constituting a "joint" extending transversely across the roadway. There are rectangular recesses 4 and 5 in the roadway to receive a seal. These recesses may be formed when the concrete is poured. Alternatively, the seals of the present invention may be applied during resurfacing, in which case they may be mounted onto the existing roadway and resurfacing material such as asphalt poured up to the level of the top of the seal.

The seal is indicated generally at 6 and comprises an elongaged block of elastomer 7 and a plate 8, extending across the roadway within the recesses 4 and 5. A series of bolt holes 9 are provided along the respective side edges of the seal, which extend downwardly through the seal to receive bolts 10 anchored in the concrete slabs. The holes 9 are counterbored to about three-eighths inch from the bottom of the seal to receive washers and nuts which hold the seals against the slabs.

The elastomer block is generally rectangular in cross-section and has grooves 11 and 12 extending along the seals, transversely of the roadway and downwardly into the seal from the top surface to positions about two-thirds of the distance from the top of the seal to its bottom. In the embodiment illustrated, each groove has its outer surface 13 nearly vertical, inclined toward the horizontal about 5°. The inner surface of each of the grooves comprises two segments. The first segment 14 extends downwardly from the top, inclined outwardly about 15° from the vertical, to about the midpoint of the seal and the second segment 15 is inclined about 60° from the vertical, extending from the first segment's lower end to the bottom of the groove where it meets the outer surface 13. The corners 16 between the two segments and the corners at the bottoms 17 of the grooves 11 and 12 are rounded. There also is a recess 18 extending upwardly into the block 7 from the bottom. Its width is approximately the same as the width of the joint 3 when the concrete achieves its greatest contraction. The recess 18 is surrounded by short vertical walls 19 and 20, a top 21 and walls 22 and 23 which are inclined at about 55° from the vertical, connecting between the vertical walls 19 and 20 and the top 21.

The elastomer is reinforced by two L-shaped plates 24 and 25 which have short vertical segments 27 and longer horizontal segments 28. The shorter segments 27 are between the bolt holes 9 and the outer side walls of the seal and the horizontal segments 28 are near the bottom of the seal, extending inwardly below the counterbored portions of bolt holes 9. In both cases only a thin layer of elastomer covers the plate, primarily to protect it from corrosion. These plates may be made of steel, e.g. about one-eighth inch thick. The plates 24 and 25 have bolt holes aligned with bolt holes 9 to receive bolts 10.

The top plate 8 is positioned to completely cover the portion of the elastomer block 7 between grooves 11 and 12, extending transversely of the joint. The plate extends upwardly above the top of the block and may be, e.g. one-sixteenth inch higher than the tops of the outboard rubber segments 208 and 208'. Its upper surface has a series of shallow, parallel, rectangular grooves 29 extending along the plate, transversely of the joint, each, e.g. one-sixteenth inch deep and about three-sixteenths inch wide. There are small grooves 30 and 31 extending inwardly into the bottoms of the plates 8, near the outer edges 32 and 33 to receive dovetailed elastomer tabs 34 and 35 which extend upwardly from the top of the elastomer block, and fasten the plate 8 to the elastomer block. The plate also has tongues 36 and 37 extending downwardly and inwardly from the outer edges 32 and 33 to a point below the middles of the dovetail tabs 34 and 35, to further anchor the plates to the elastomer block. If desired, adhesive can be used between the bottom of the plate and the elastomer block.

The plate 8 may be an aluminum alloy extrusion or other metal which is resistant to corrosion, particularly to corrosion caused by water and the various chemicals which are used to remove ice and snow from roadways such as sodium chloride and calcium chloride crystals. It also should be highly resistant to abrasion and should not be brittle or subject to chipping. The essential requirement is that the plate be more resistant than the rubber to the kind of abrasion encountered in roadways. Moreover, since the plate can perform the added function of a reinforcing plate over the joint, it should be stiffer than the elastomer, i.e., more resistant to bending. Therefore, in principle, certain very hard plastics as well as other kinds of metals can be used. As used herein, the word plate refers to a rather thin shaped object, thinner than the elastomer block and wider and longer than it is thick. Typically it may be 1/16 – ¾ inch thick.

A wide variety of elastomers may be used in the elastomer block. However, it is preferred to use those materials which are resistant to sunlight, temperature extremes, oil and oxidation, e.g. neoprene.

The seals are typically made in six foot lengths, with tongue and groove or other joints at their ends to fasten adjoining sections to each other. Adhesive may be used at such joints. In addition, the top plates 8 of adjoining sections may be welded together.

Figure 3:
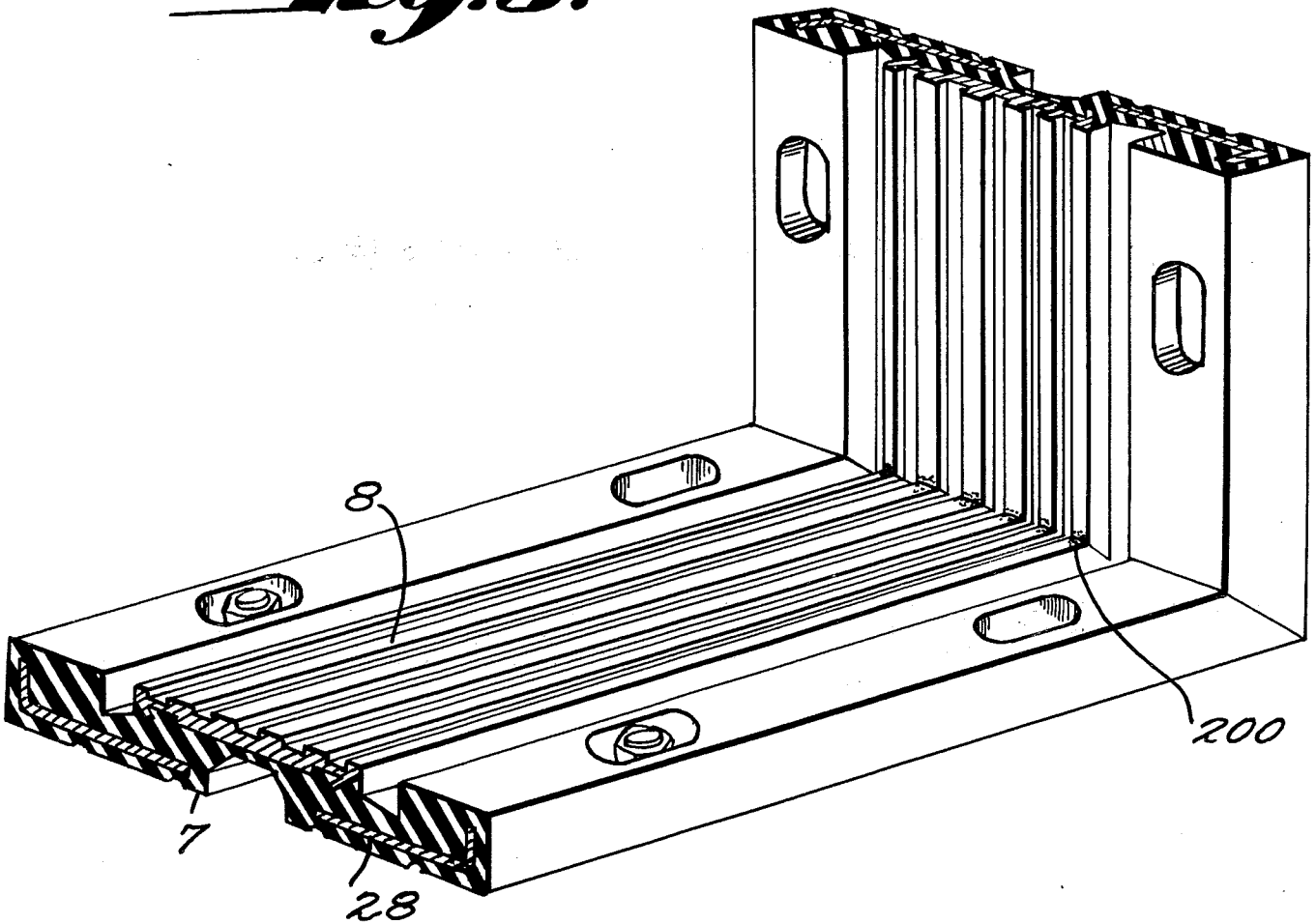
FIGS. 3 and 4 are perspective views of seals formed to be mounted at curbs.
Figure 4:
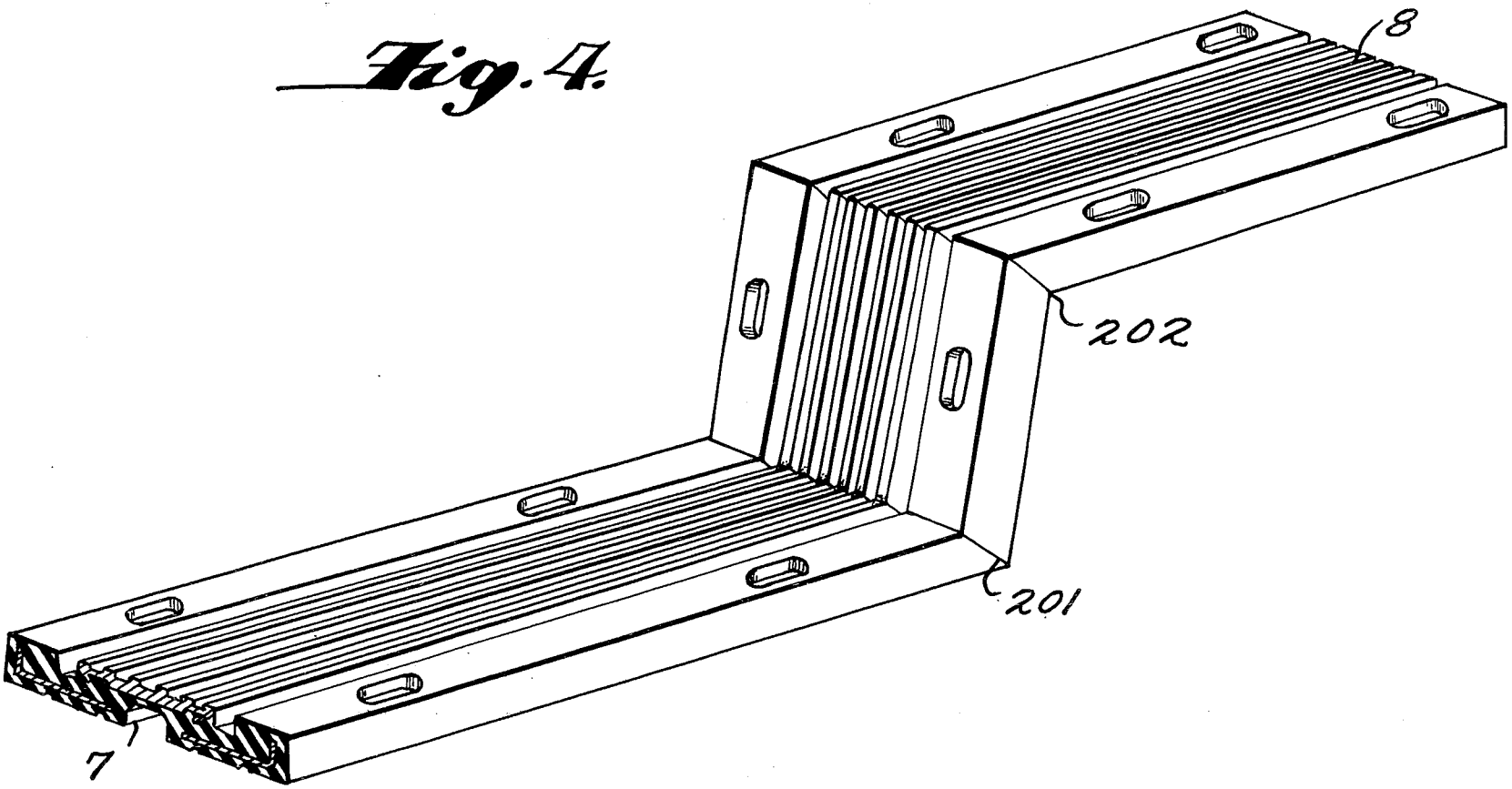

FIGS. 3 and 4 illustrate in perspective view bending of the seal of FIG. 1 to conform to the joint at the edge of the roadway and a bridge. FIG. 3 illustrates the bend formed for a curb which is perpendicular to the roadway whereas FIG. 4 illustrates the bending of the joint to a curb which is inclined upwardly and outwardly from the roadway and to cross a walkway.

The embodiment shown in FIG. 3 is produced by making a V-shaped cut downwardly into the seal of FIG. 1, and bending the seal until the cut edges of the rubber meet. Generally it is sufficient to cut down to the tops of the horizontal segments 28, and then those segments are bent along with the thin layer of rubber below them. This arrangement assures that the rubber will not tear at the bend, separating the portion of the seal below the horizontal segments. In addition, it reduces the likelihood of leaking through the seal at the joint, because there is a continuous layer of elastomer.

In the embodiment shown, the top plate 8 is welded at 200 to firmly secure together the vertical and horizontal sections of the seal which they meet. This is particularly important when it is not possible to bolt the vertical section directly to the curb, and also reduces the likelihood of separation during shipment from a factory to the site where the seal is to be installed.

FIG. 4 illustrates a similar joint at 201, and also a bend in the opposite direction at 202. The reverse bend 202 is formed by cutting an inverted V-shaped wedge from the seal and bending until the cut edges meet. The wedge may be cut to the lower edges of the top plate 8, and that plate is bent with the rubber.

Thus by welding the top plate 8 in the concave bend shown in FIG. 3, and by bending the top plate 8 in forming the convex bend 200, it is possible to provide a continuous metal plate reinforcing the seal at the curb joint.

Figure 2:
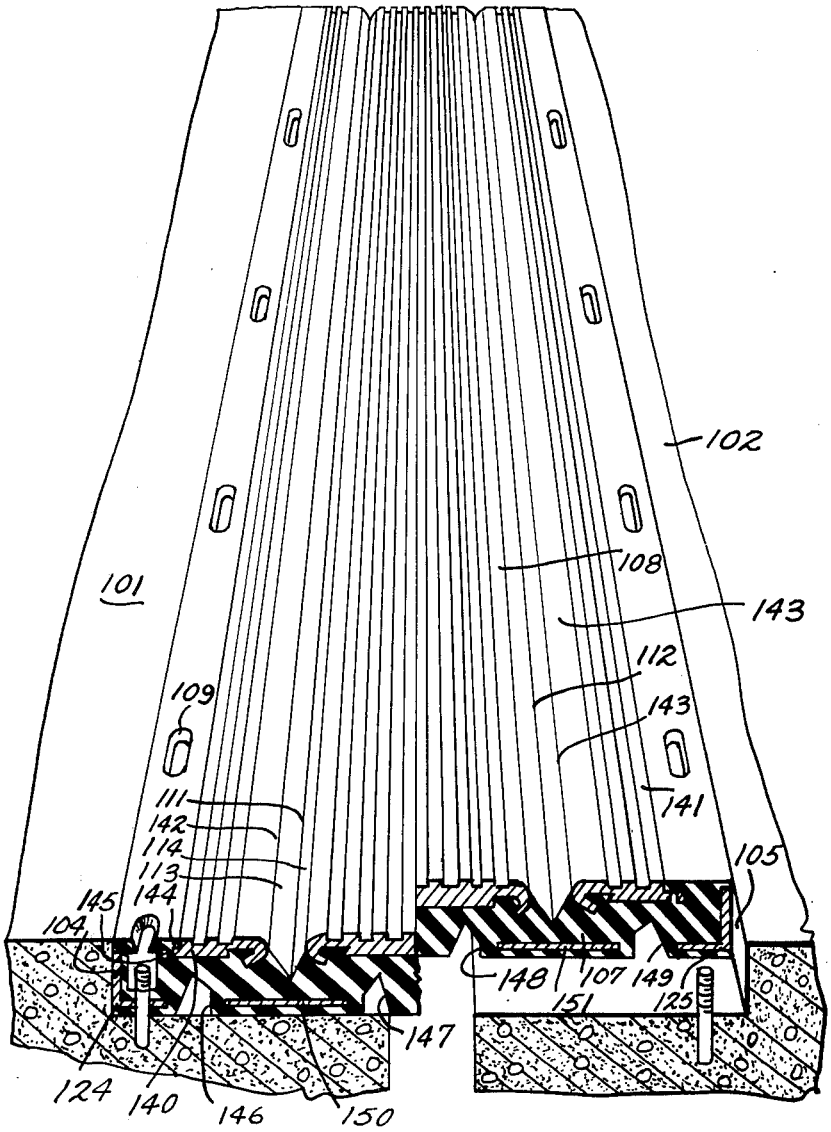
FIG. 2 is a similar view of a seal according to the invention in a larger joint.

The embodiment shown in FIG. 2 is adapted to wider joints and is characterized by two additional metal plates. The seal comprises an elastomer block 107 of generally rectangular shape resting in recesses 104 and 105 in the adjoining concrete slabs 101 and 102. There are two V-shaped grooves 111 and 112 extending downwardly from the top surfaces, having side walls 113 and 114 inclined about 35° from vertical and extending to a point about one-half - two-thirds of the distance from the top of the block. Each of these grooves is positioned inwardly from the outer edge of the block about one-fourth to one-third of the overall width of the block. Counterbored bolt holes 109 are provided which are similar to the bolt holes 9 in the embodiment of FIG. 1.

There is a longitudinally extending top plate 108 over the top of the central portion of the block which is essentially the same as the corresponding plate in the embodiment of FIG. 1, and which is fastened to the top of the elastomer block in essentially the same way. Since the segments of the top surface between grooves 111 and 112 and the respective side edges of the elastomer block are wider than in the embodiment of FIG. 1, additional top plates 140 and 141 are provided of the same kind of material as plate 108. These have inner edges 142 and 143 which are rounded in the same way as the side edges of plate 108. Adjacent edges 142 and 143, the plates 140 and 141 are anchored to the rubber by dovetails which are essentially the same as described in connection with FIG. 1. The outer edges of the plates 140 and 141 are connected to the rubber by pinned tongue and groove joints including flanges 144 extending outwardly from the lower portions of the plates and having holes 145 spaced along the plate, with elastomer pins extending through those holes. If desired, the plates 140 and 141 could be extended to the outer edges of the elastomer, and anchored in the same manner as at edges 142 and 143, with holes drilled through the plates in alignment with bolt holes 109.

There are four longitudinal grooves 146, 147, 148 and 149 extending upwardly from the bottom of the block at spaced positions across it. These may be of the general shape shown for the grooves in the top surface of the embodiment of FIG. 1.

There are, in the seal of FIG. 2, L-shaped plates 124 and 125 corresponding to plates 24 and 25 of the embodiment of FIG. 1. However, the horizontal segments are not as wide, extending to near grooves 146 and 149. Additional reinforcing plates 150 and 151 may be positioned in the rubber, parallel to but slightly above the bottom, respectively between grooves 146 and 147, and between grooves 148 and 149.

Curb joints similar to those illustrated in FIGS. 3 and 4 can be formed from the seal of FIG. 2.

Figure 5:
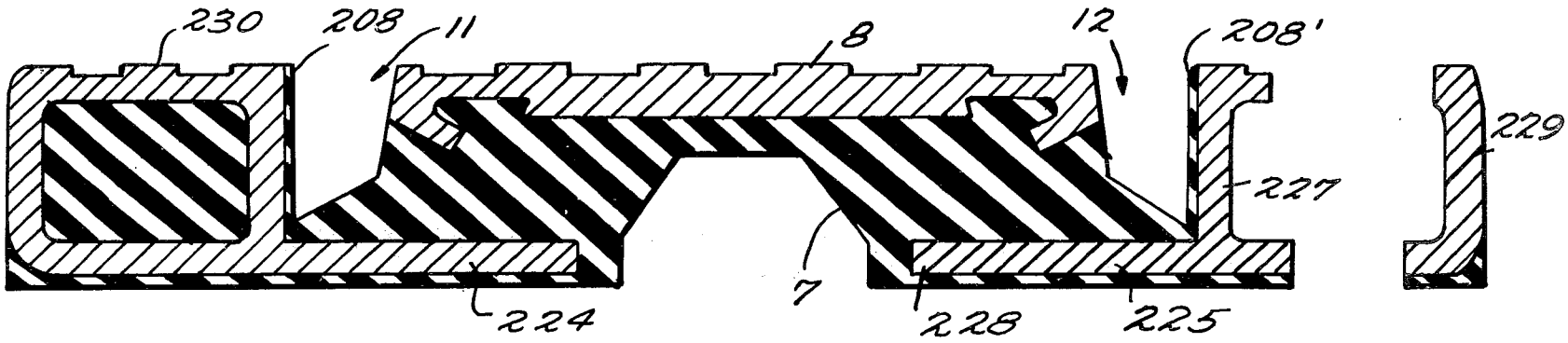
FIG. 5 is a cross-section through another embodiment of the seal of FIG. 1.

The embodiment illustrated in FIG. 5 provides a convenient way to cover substantially the entire upper surface of the seal with a skid resistant metal surface.

The seal illustrated has substantially the same configuration as the seal illustrated in FIG. 1 and therefore like numerals have been used to identify like parts. However, the L-shaped plates 24 and 25 are replaced with plates 224 and 225. Each of these includes a horizontal segment 228, two vertical segments 227 and 229 and top segment 230 which connects the upper ends of segments 227 and 229. The segment 230 is, by means of its integral attachment to segments 227 and 229, secured to the top of one of the outboard rubber segments 208 and 208'. The space between the vertical segments 227 can be filled with rubber or left hollow, or may be solid metal. It also is possible to use separate metal blocks or tubes in lieu of the outboard segments 208 and 208', and to mold the seal with a flat plate corresponding to the horizontal segments 28 extending laterally outwardly. The separate metal blocks or tubes are then bolted over those horizontal plates with the same bolts as hold the seal onto the pavement.

As indicated above, the seal is mounted in the pavement by means of bolts 10 and nuts. If desired, a plastic or rubber membrane may be laid between the pavement material and the elastomer block, and the block may be anchored in place with a liquid adhesive and/or sealing material, to preclude moisture or debris leaking between the elastomer and the pavement material. As the joints open and close from contraction and expansion of paving materials, movement is taken up by opening and closing of the grooves in the elastomer. On bridges, which have shearing and other movements in addition to the thermal expansion and contraction of paving material, the seals are capable of taking up a wide variety of such movements.

The seals provide a convenient means for providing a covering and reinforcing plate over a joint which performs many of the functions of the cover plates usually applied over wide expansion joints. Moreover, the plate protects the surface of the elastomer from wear by traffic and especially snow plows which can tear rubber. By welding the top plates of adjacent sections of the seal, it is possible to provide a continuous metal plate across the entire roadway, at the curbs, and across adjoining walkways.

The corners of the elastomer block adjacent grooves are especially well protected. The dovetail fastening between the top plates and the elastomer blocks assures good resistance to delamination of the plate from the block. The grooves in the top surface of the plate reduce the risk of skidding inherent in a rubber-topped seal. The seal also is relatively easy to replace, requiring no substantial work on the pavement itself. Therefore, it will be apparent that the invention provides a seal for expansion joints having many advantages.

It will be appreciated that, while certain preferred embodiments have been illustrated and described in detail, no limitation thereto is intended. Various changes may be made in details of construction and mode of operation without departing from the scope of the invention, as hereinafter defined.

We claim:

1. A prefabricated seal for a pavement joint comprising an elongated block of elastomer of substantially rectangular cross-section, means adjacent the transverse edges of said block to secure said joint to the edges of said pavement adjoining said joint, said block having at least two laterally-spaced grooves extending longitudinally therealong and vertically downward into the block from its top surface to permit expansion and contraction of the seal in accordance with the width of said joint, a metal top plate secured to the top of said block and covering the entire portion of the top surface between a pair of said grooves which are adjacent to each other, said plate being secured to the joint solely by said elastomer block, extending downwardly over the upper edge of the elastomer adjoining each of said grooves and having a pair of tongues extending downwardly and inwardly into said elastomer, to protect the edges of said elastomer and resist delamination.

2. A seal as set forth in claim 1 including two additional metal top plates covering at least a portion of the segments of the top surface of said elastomer block between said downwardly-extending grooves and the transverse edges of the block, said additional plates extending laterally outwardly from said downwardly-extending grooves, each of said additional plates extending downwardly over the upper edge of the outermost groove and having a tongue extending downwardly and inwardly into said elastomer to protect the edge of said elastomer and resist delamination.

3. A prefabricated seal for a pavement joint comprising an elongated block of elastomer of substantially rectangular cross-section, said block having a plurality of holes extending vertically through it at spaced points along a line adjacent one transverse edge and a plurality of holes extending vertically through it at spaced points along a line adjacent the other transverse edge, to receive bolts anchored to the respective pavement sections which meet at said joint, said block having at least two laterally-spaced grooves extending longitudinally therealong and vertically downward into the block from its top surface to permit expansion and contraction of the seal in accordance with the width of said joint, a metal top plate secured to the top of said block and covering the entire portion of the top surface between a pair of said grooves which are adjacent to each other, said plate having in its top surface a plurality of parallel rectangular cross-section grooves extending therealong and transversely of the joint to reduce skidding of vehicles passing over said joint, said plate also having a pair of laterally–spaced, dovetail-shaped grooves extending along its lower surface adjacent the respective transverse edges of the plate, and a pair of tongues extending downwardly and inwardly from the transverse edges of said plate to positions under said dovetail grooves, said elastomer block having dovetails extending into said dovetail grooves to anchor the plate to the elastomer block, and said plate being secured to said pavement sections solely by its attachment to said elastomer block.

4. A seal as set forth in claim 3 including two additional metal top plates covering at least a portion of the segments of the top surface of said elastomer block between said downwardly-extending grooves and the transverse edges of the block, said additional plates extending laterally outwardly from said downwardly-extending grooves, each of said additional plates having parallel rectangular cross-section longitudinal grooves extending along its top surface for skid resistance, each of said additional plates having a dovetail shaped groove in its lower surface adjacent the edge which adjoins said downwardly-extending groove, and each of said additional plates having a tongue extending downwardly and outwardly of said seal to a position under said dovetail-shaped groove, said elastomer block having dovetails extending into the dovetail grooves of said additional plates.

5. In a sealed pavement joint system comprising two adjoining sections of pavement separated by a joint which receives said sections during thermal expansion, and a prefabricated seal secured to said sections and sealing said joint to reduce the likelihood of intrusion of foreign substances;

the improvement wherein said seal comprises an elongated block of elastomer of substantially rectangular cross-section, said block having a plurality of holes extending vertically through it at spaced points along a line adjacent the other transverse edge, to receive bolts anchored to the respective pavement sections which meet at said joint, said block having at least two laterally-spaced grooves extending longitudinally therealong and vertically downward into the block from its top surface to permit expansion and contraction of the seal in accordance with the width of said joint, a metal top plate secured to the top of said block and covering the entire portion of the top surface between a pair of said grooves which are adjacent to each other, said plate having in its top surface a plurality of parallel rectangular cross-section grooves extending therealong and transversely of the joint to reduce skidding of vehicles passing over said joint, said plate also having a pair of laterally-spaced dovetail-shaped grooves extending along its lower surface adjacent the respective transverse edges of the plate, and a pair of tongues extending downwardly and inwardly from the transverse edges of said plate to positions under said dovetail grooves, said elastomer block having dovetails extending into said dovetail grooves to anchor the plate to the elastomer block, and said plate being secured to said pavement sections solely by its attachment to said elastomer block.

6. A sealed pavement joint system as set forth in claim 5 including the further improvement comprising two additional metal top plates covering at least a portion of the segments of the top surface of said elastomer block between said downwardly-extending grooves and the transverse edges of the block, said additional plates extending laterally outwardly from said downwardly-extending grooves, each of said additional plates having parallel rectangular cross-section longitudinal grooves extending along its top surface for skid resistance, each of said additional plates having a dovetail shaped groove in its lower surface adjacent the edge which adjoins said downwardly-extending groove, and each of said additional plates having a tongue extending downwardly and outwardly of said seal to a position under said dovetail-shaped groove, said elastomer block having dovetails extending into the dovetail grooves of said additional plates.

7. In a sealed pavement joint system comprising two adjoining sections of pavement separated by a joint which receives said sections during thermal expansion, and a prefabricated seal secured to said sections and sealing said joint to reduce the likelihood of intrusion of foreign substances;

the improvement wherein said seal comprises an elongated block of elastomer of substantially rectangular cross-section, means adjacent the transverse edges of said block securing said joint to the edges of said pavement adjoining said joint, said block having at least two laterally-spaced grooves extending longitudinally therealong and vertically downward into the block from its top surface to permit expansion and contraction of the seal in accordance with the width of said joint, a metal top plate secured to the top of said block and covering the entire portion of the top surface between a pair of said grooves which are adjacent to each other, said plate being secured to the joint solely by said elastomer block, extending downwardly over the upper edge of the elastomer adjoining each of said grooves and having a pair of tongues extending downwardly and inwardly into said elastomer to protect the edges of said elastomer and resist delamination.

8. A sealed pavement joint system as set forth in claim 7 including the further improvement comprising two additional metal top plates covering at least a portion of the segments of the top surface of said elastomer block between said downwardly-extending grooves and the transverse edges of the block, said additional plates extending laterally outwardly from said downwardly-extending grooves, each of said additional plates extending downwardly over the upper edge of the outermost groove to protect the edge of said elastomer and resist delamination.

* * * * *